US011653779B2

(12) United States Patent
Linhard et al.

(10) Patent No.: US 11,653,779 B2
(45) Date of Patent: May 23, 2023

(54) DRINK HOLDER

(71) Applicants: Charlene Linhard, Aurora, CO (US); Robert Fulleman, Aurora, CO (US)

(72) Inventors: Charlene Linhard, Aurora, CO (US); Robert Fulleman, Aurora, CO (US)

( * ) Notice: Subject to any disclaimer, the term of this patent is extended or adjusted under 35 U.S.C. 154(b) by 0 days.

(21) Appl. No.: 17/470,473

(22) Filed: Sep. 9, 2021

(65) Prior Publication Data

US 2022/0071423 A1 Mar. 10, 2022

Related U.S. Application Data

(60) Provisional application No. 63/076,607, filed on Sep. 10, 2020.

(51) Int. Cl.
*A47G 23/02* (2006.01)

(52) U.S. Cl.
CPC ..... *A47G 23/0216* (2013.01); *A47G 2400/10* (2013.01)

(58) Field of Classification Search
CPC ..... A47G 2400/083; A47G 9/1045; A47G 23/0216; A47G 23/02; A47G 23/0208; A47G 2400/10; A47G 2023/0275; A47G 2023/0283; A47G 2023/0291; B65D 81/3876; B65D 81/3886; B65D 81/3888; B65D 81/3897; B65D 25/005
USPC ..... 248/346.2, 346.11
See application file for complete search history.

(56) References Cited

U.S. PATENT DOCUMENTS

| | | | | |
|---|---|---|---|---|
| 2,589,098 | A | 3/1952 | Lanpher | |
| 3,028,702 | A | 4/1962 | St Cyr | |
| 3,312,436 | A | 4/1967 | Beghetto | |
| 3,831,209 | A | 8/1974 | Clingman | |
| 4,889,302 | A | 12/1989 | Tucker | |
| 4,964,600 | A | 10/1990 | Lee | |
| D441,914 | S | 5/2001 | Armour | |
| 6,581,888 | B1 * | 6/2003 | Castillo | A47G 23/0225 248/910 |
| 6,755,380 | B2 | 6/2004 | Pace | |
| 6,843,458 | B1 | 1/2005 | Robinson | |
| 8,646,740 | B1 * | 2/2014 | Nelson | A47G 23/0306 215/393 |
| 9,803,681 | B2 | 10/2017 | Esposito | |
| 2003/0122050 | A1 * | 7/2003 | Dauer | A47G 23/032 248/346.11 |
| 2004/0155047 | A1 * | 8/2004 | DeBartolo | A47G 23/0216 220/737 |
| 2006/0145033 | A1 | 7/2006 | McCombs | |
| 2007/0131834 | A1 * | 6/2007 | Reid | G09F 23/06 248/346.11 |

(Continued)

FOREIGN PATENT DOCUMENTS

| | | | |
|---|---|---|---|
| WO | 9102475 | A1 | 3/1991 |
| WO | 2011060039 | A3 | 9/2011 |
| WO | 2015069326 | A1 | 5/2015 |

*Primary Examiner* — Don M Anderson
(74) *Attorney, Agent, or Firm* — Leyendecker & Lemire LLC

(57) ABSTRACT

A weighted bead filled drink holder with flexible sheet material is described sides that cradles a beverage receptacle inserted into it and lowers the effective center of gravity of the combination and provides a wide footprint to make the combination extremely stable on a variety of surfaces including surfaces on which cups and glasses, especially stemware are unstable.

20 Claims, 8 Drawing Sheets

(56) References Cited

U.S. PATENT DOCUMENTS

| | | | | |
|---|---|---|---|---|
| 2007/0205205 | A1 | 9/2007 | Kliewer | |
| 2014/0246447 | A1 | 9/2014 | Wenceslao | |
| 2015/0060475 | A1* | 3/2015 | Mellentine | A47G 23/0216 220/739 |
| 2019/0350393 | A1* | 11/2019 | Storey-Knight | A47G 23/0216 |
| 2021/0076856 | A1* | 3/2021 | Pavlou | A47G 23/0208 |
| 2021/0371049 | A1* | 12/2021 | Ford | A45F 5/00 |

* cited by examiner

DRINK HOLDER

RELATED APPLICATIONS

This application incorporates by reference and claims priority to U.S. Provisional Patent Application No. 63/076,607 entitled Drink Holder, filed on 10 Sep. 2020, and having the same inventorship as the present application.

BACKGROUND

Drinks contained in cup, bottle, can and glasses especially when full often tend not to be particularly stable when placed on a soft or potentially shifting surface, such as but not limited to thick carpet, a mattress, a foam pad, and a couch or chair sitting surface or arm. Simply, the high center of gravity of a full drink vessel relative ti its width or diameter causes it to easily tip over and spill even when angled only slightly off of vertical. Stemware is especially susceptible to tipping such that even momentarily leaving a filled wine glass on a sitting surface is highly likely to result in a spill.

Glass/cup holders have been proposed that will stabilize some types of drinking vessels but they all tend to suffer from one drawback or another. For instance, several solutions comprise weighted bags (such as bean bags) that surround a rigid container in which a beverage container is placed. The rigid containers within the weighted bag outer portion do help stabilize a container placed therein if it is the appropriate size and dimensions, but can often neither receive larger container nor fully support smaller containers. These kind of containers cannot, for instance, receive and provide adequate support to stemware.

DETAILED DESCRIPTION

Figure 1:
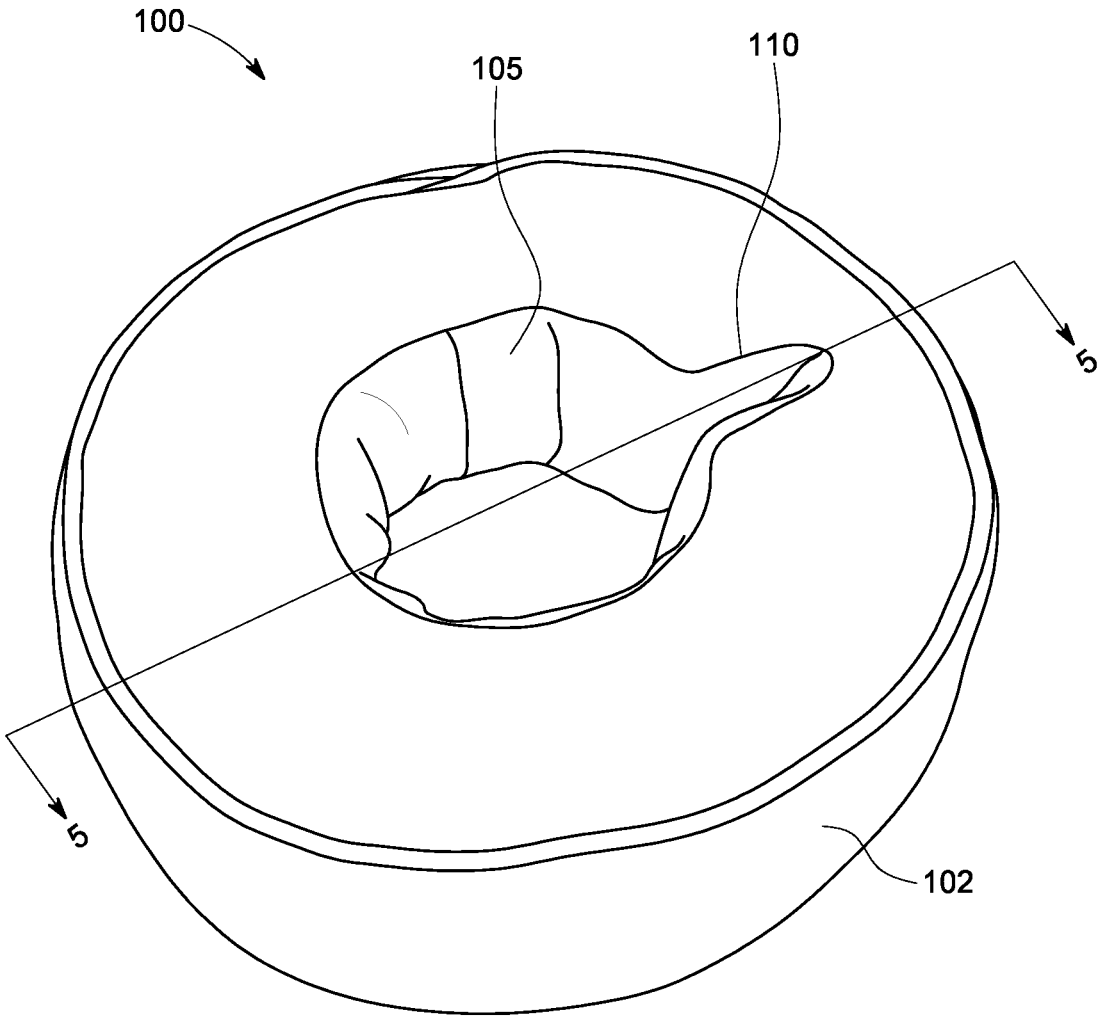
FIG. 1 is an isometric top view of a drink holder according to an embodiment of the present invention.

Embodiments of the present invention comprise a weighted bead filled drink holder with flexible sheet material sides that, advantageously cradles a cup or glass inserted into it, lowers the effective center of gravity of the combination, and provides a wide footprint to make the combination extremely stable on a variety of surfaces including surfaces on which cups and glasses, especially stemware, are unstable. For instance, embodiments of the combination are stable, even when the associated beverage receptacle is filled and placed on chairs, couches and mattresses.

At least one embodiment of present invention comprises a donut-shaped section (also referred to herein as the "donut" or the "donut section") having a generally cylindrical center hole receptacle extending therethrough from an open top side to an open bottom side. The receptacle also includes a notch portion that extends generally radially into the donut-shaped section. The donut is comprised of a flexible material exterior usually comprising fabric or another flexible sheet material, such as Polyurethane leather, filled with beads. The beads give structure to the donut but are also forgiving allowing the flexible material-sided donut to conform to a drinking receptacle inserted therein. The notch portion permits coffee cups and other receptacles with handles to be received in the center hole by providing an accommodation for a handle. The notch can also be used to provide support to the stem of a piece of stemware.

A bottom ("bottom section") is attached to the donut along the outside perimeter of the donut's bottom side where it intersects the exterior side of the donut. This permits the insertion of the stem of a piece of stemware into the notch portion by providing a slot between the bottom side of the donut and the bottom for the base of the stemware. The weight of the beads cause the overlying donut bottom side to conform to the top side of the stemware's base and, as such, provide for additional stability.

Terminology

The terms and phrases as indicated in quotation marks (" ") in this section are intended to have the meaning ascribed to them in this Terminology section applied to them throughout this document, including in the claims, unless clearly indicated otherwise in context. Further, as applicable, the stated definitions are to apply, regardless of the word or phrase's case, to the singular and plural variations of the defined word or phrase.

The term "or" as used in this specification and the appended claims is not meant to be exclusive; rather the term is inclusive, meaning either or both.

References in the specification to "one embodiment", "an embodiment", "another embodiment, "a preferred embodiment", "an alternative embodiment", "one variation", "a variation" and similar phrases mean that a particular feature, structure, or characteristic described in connection with the embodiment or variation, is included in at least an embodiment or variation of the invention. The phrase "in one embodiment", "in one variation" or similar phrases, as used in various places in the specification, are not necessarily meant to refer to the same embodiment or the same variation.

The term "couple" or "coupled" as used in this specification and appended claims refers to an indirect or direct physical connection between the identified elements, components, or objects. Often the manner of the coupling will be related specifically to the manner in which the two coupled elements interact.

The term "directly coupled" or "coupled directly," as used in this specification and appended claims, refers to a physical connection between identified elements, components, or objects, in which no other element, component, or object resides between those identified as being directly coupled.

The term "approximately," as used in this specification and appended claims, refers to plus or minus 10% of the value given.

The term "about," as used in this specification and appended claims, refers to plus or minus 20% of the value given.

The terms "generally" and "substantially," as used in this specification and appended claims, mean mostly, or for the most part.

Directional and/or relationary terms such as, but not limited to, left, right, nadir, apex, top, bottom, vertical, horizontal, back, front and lateral are relative to each other and are dependent on the specific orientation of an applicable element or article, and are used accordingly to aid in the description of the various embodiments and are not necessarily intended to be construed as limiting.

As used herein, the terms "drinking vessel", "beverage receptacle", "cup", "glass" are to be considered interchangeable unless clearly distinguishable in context. For instance, the phrase "coffee cup" refers to a specific type of cup or drinking vessel with a handle on the side that typically has a capacity of around a cup to about 1.5 to two cups. Similarly, the phrase "wine glass" as used herein refers to a piece of stemware having a base (or foot), a stem and a bowl.

The term "fill" or "fill material" refers to any material whether by itself or in aggregate that when contained in a hollow structure at least partially comprised of flexible walls flows or moves with relative ease in response to an external force placed on the flexible walls. "Fill" that can be used in embodiments of the drink hold can include "liquid", "gel", granular particulate, and beads.

The phrase "fill beads" refers to beads or other small solid particles or particulate of a relatively uniform size and shape that in aggregate approximate the behavior of a liquid.

As used herein "flexible sheet material" refers to a sheet material that can readily bend and move without appreciable residual deformation. Some examples of "flexible sheet materials" include fabric, leather, faux leather, and thin sheet elastomers and thin sheet plastics.

An Embodiment of the Drink Holder

An embodiment of a drink holder is illustrated in FIGS. 1-9 either by itself or in combination with various beverage receptacles. With primary reference to FIGS. 1 & 5, the drink holder is comprised of a donut section 102 and a bottom section 130.

The donut section 102 is in the shape of a donut with a top side a bottom side and at least one exterior side extending between. As shown, the donut section is circular in shape and about eight inches in diameter with a height of about three inches, although the dimensions can vary in other embodiments The donut section further has an interior side that defines a generally cylindrical center hole 105. The center hole extends from a bottom opening on the donut bottom side to a top opening on the donut top side. In the illustrated embodiment, the center hole is about three inches in diameter, although it can vary in other embodiments and other variations. A interior side further defines a radial notch 110 that is co-extensive with the center hole extending from a bottom notch opening to a top notch opening. In the illustrated embodiment, the distance between the interior side and the exterior side is about 2.3". The notch extends radially outwardly about 1-1.3" from the center hole.

The sides of the donut section 102 are comprised of flexible sheet material that can comprise several panels that are joined together by any suitable means including, but limited to sewing, adhesive bonding, and fusion joining. The flexible sheet material can include one or more of thin plastic sheet, thin elastomeric sheet, faux leather including vinyl and polyurethane leather, leather, and woven non-woven fabrics. Of note, in the illustrated embodiment piping trim is provided at the intersection of the donut top side and the exterior side, and the intersection of the donut bottom side and the exterior side.

The sides of the donut 102 define an interior space comprising a ring with a generally rectangular cross section, although it is appreciated the cross sectional shape can vary in other embodiments and variations. The interior space is filled with a fill material 120, such as gel, water, sand, plastic beads, foam beads, rice, and beans. In at least one embodiment, the fill comprises about 50% plastic beads and 50% foam beads.

When solid particulate is used as the fill 120, it can vary in size and shape, but generally particulate and beads are preferred having rounded shapes so that the beads or particulate easily glide past each other and flow within the confines of the interior space permitting the donut to conform around the beverage receptacle placed therein. Ideally to facilitate conformability, the particulate or beads are no greater than about 0.25" in length or diameter with particles having a width or diameter of less than 0.125" preferred.

As can be appreciated the weight of the fill comprises a significant portion of the overall weight of the donut 102 and the drink holder 100. The weight of the drink holder, which is typically between 1-2 pounds, along with its diameter are both critical in providing stability to an associated beverage receptacle, including a beverage contained therein, in combination with the drink holder. Essentially, the weight of the drink holder provides for a lower center of gravity for the combination compared with the beverage-containing beverage receptacle alone. This lowered center of gravity is most notable when compared to the center of gravity of stemware wherein the center of gravity is very high when a beverage is contained in the stemware's bowl. The wide base coupled with the combined center of gravity makes it very unlikely that the combination can tip over and spill the beverage contents thereof. Accordingly, as long as the beverage receptacle is firmly cradled in the drink holder the risk of tipping is greatly diminished if not eliminated.

The bottom section 130 of the drink holder 100 typically comprises a circular piece of flexible sheet material, although it ultimately approximates the shape of the perimeter of the donut section 102. Often, but not necessarily, the sheet material used in the bottom section is the same type as is used in the donut section. In some variations, it can be a bit heavier and less flexible, and in some variations may further include an anti-slip or friction enhancing outer portion to better adhere to an underlying surface.

As mentioned above, the perimeter of the bottom section 130 is secured to the donut section 102 proximate the perimeter of the donut section proximate the intersection of its bottom side and its generally vertical exterior side. In the illustrated embodiment, the bottom section is sewn to the donut section and piping is provided around the seam for aesthetics and added protection. The manner in which the bottom section is jointed to the donut section creates a annular slot 107 around the bottom opening of the center hole and extending outwardly therefrom.

Figure 2:
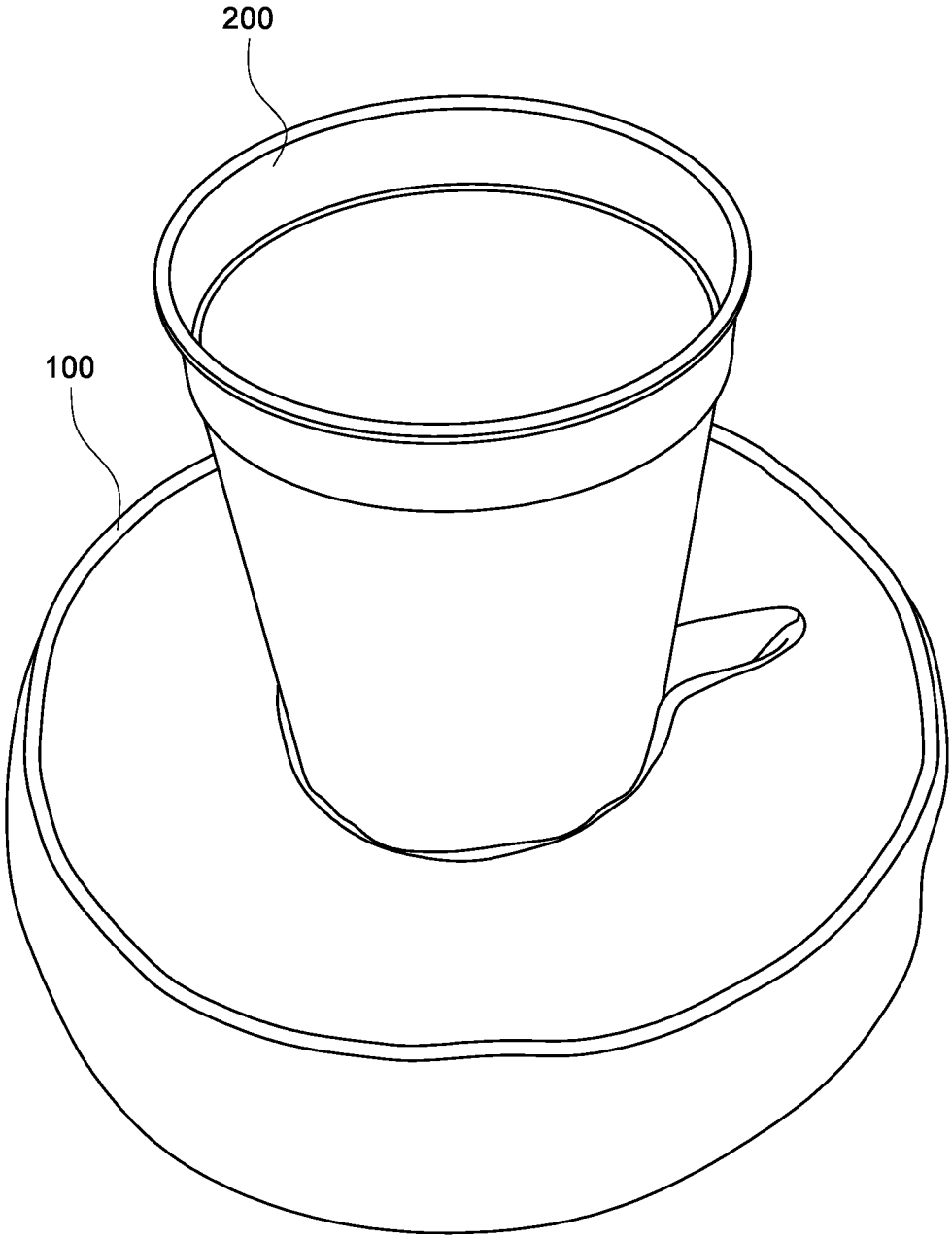
FIG. 2 is an isometric top view of a drink holder with a cup received therein according to an embodiment of the present invention.
Figure 3:
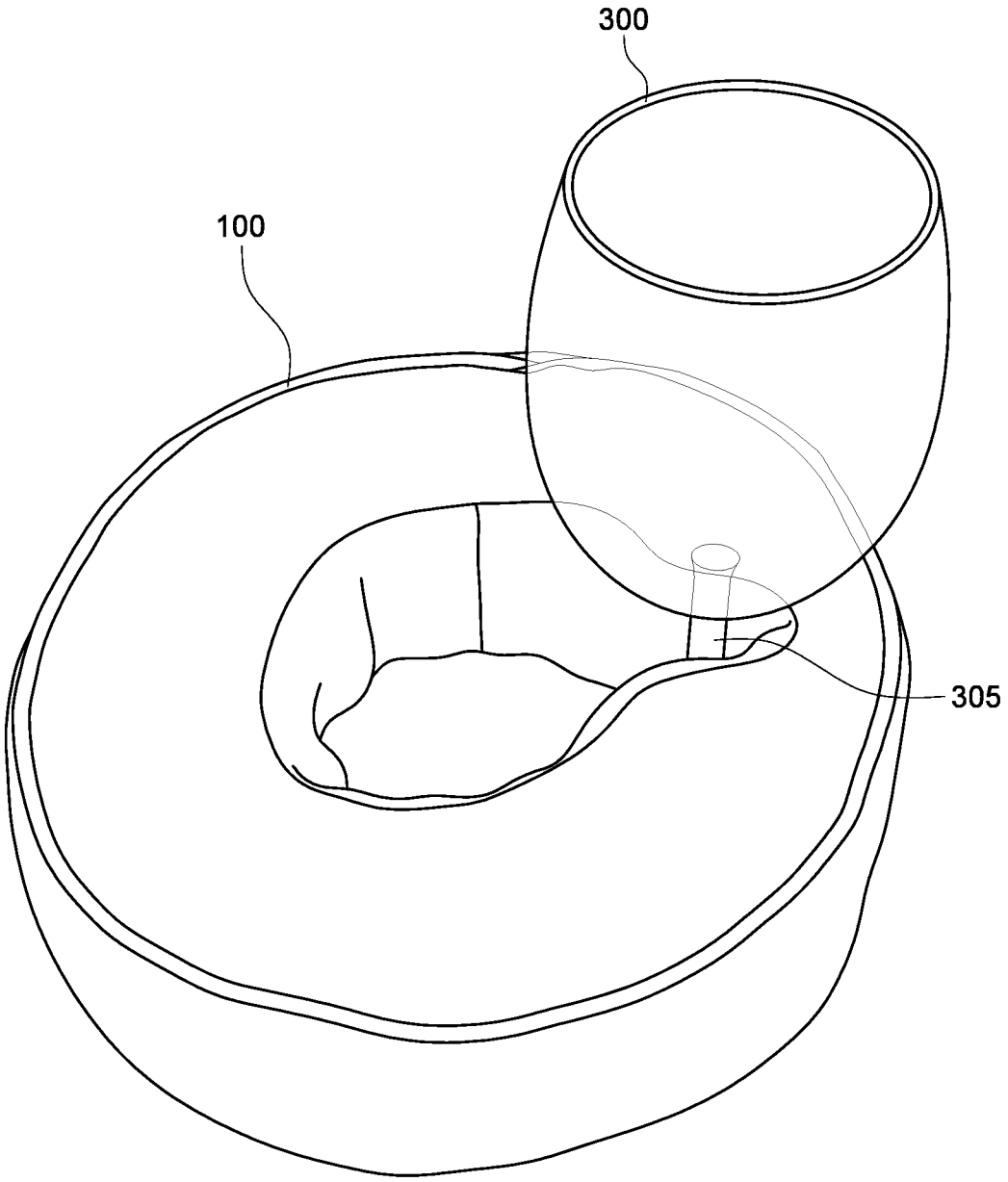
FIG. 3 is an isometric top view of a drink holder with a wine glass received therein according to an embodiment of the present invention.
Figure 4:
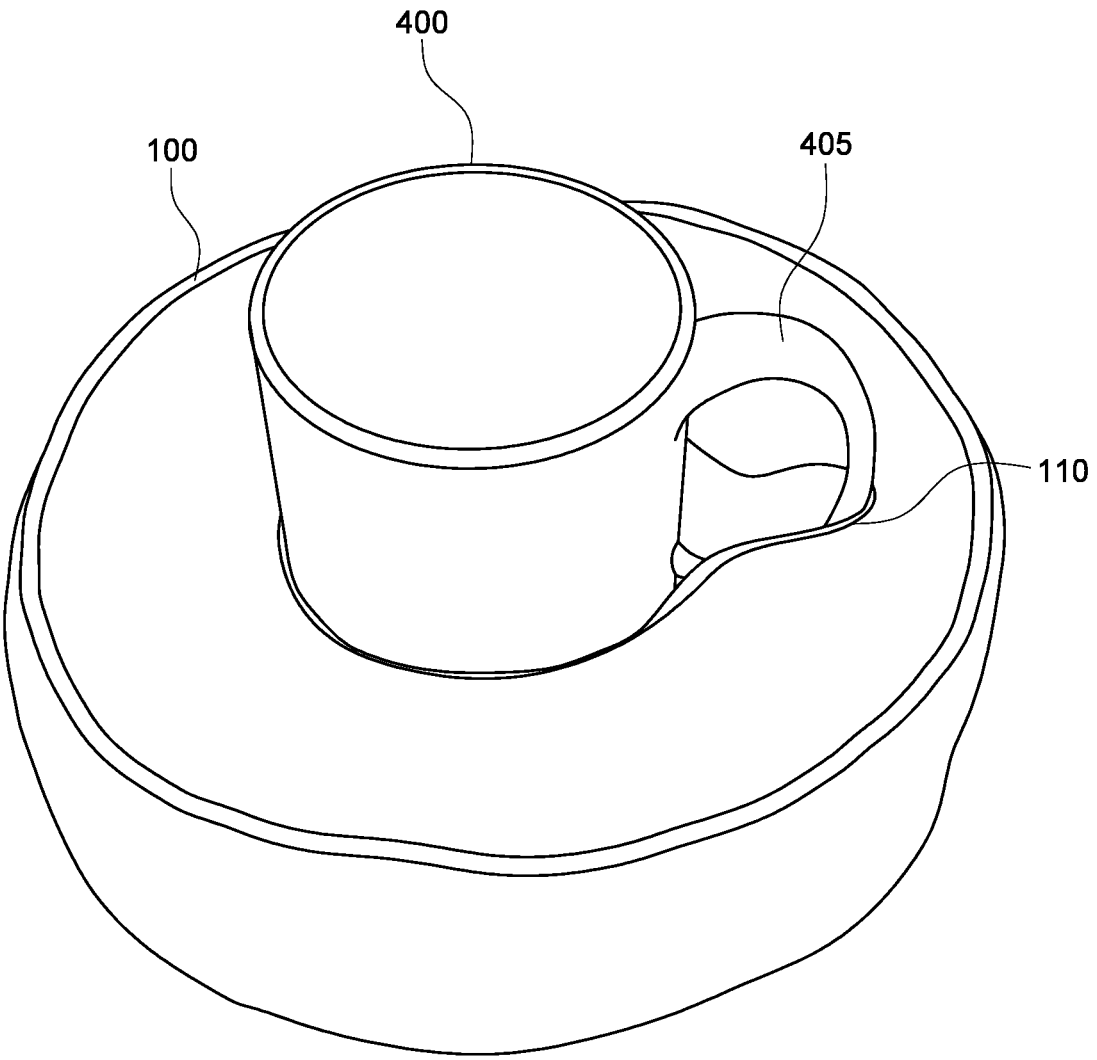
FIG. 4 is an isometric top view of a drink holder with a coffee cup received therein according to an embodiment of the present invention.
Figure 5:
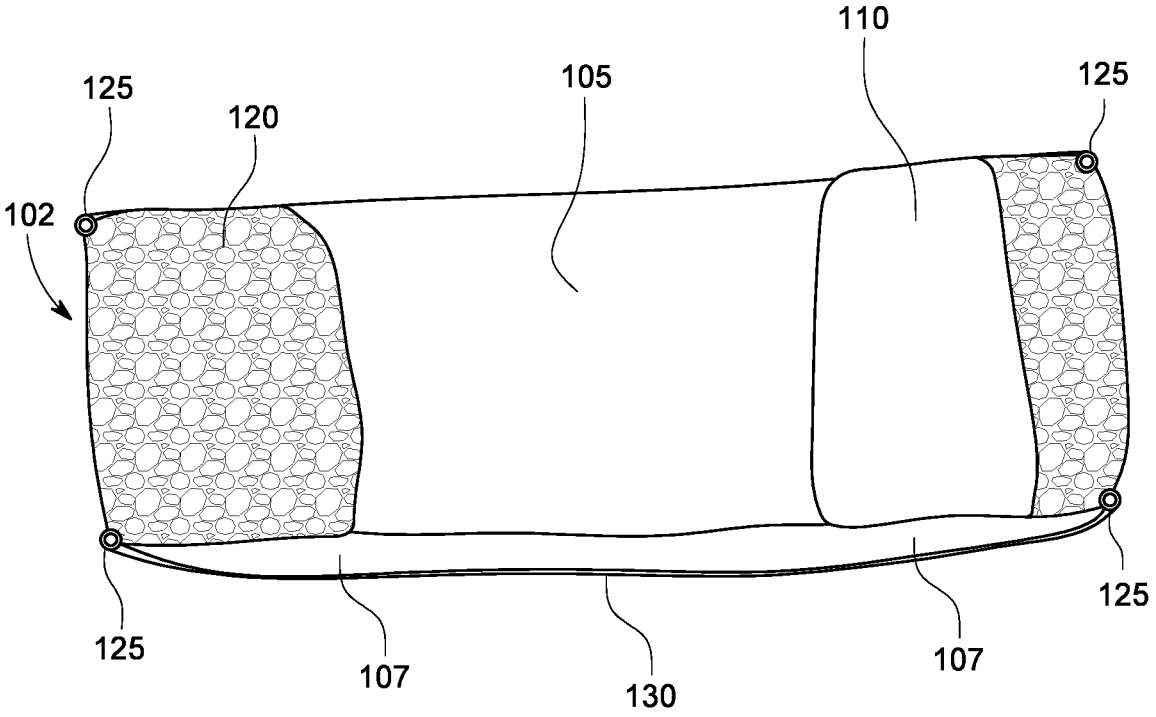
FIG. 5 is a cross sectional view of a drink holder taken across line 5-5 of FIG. 1 according to an embodiment of the present invention.
Figure 6:
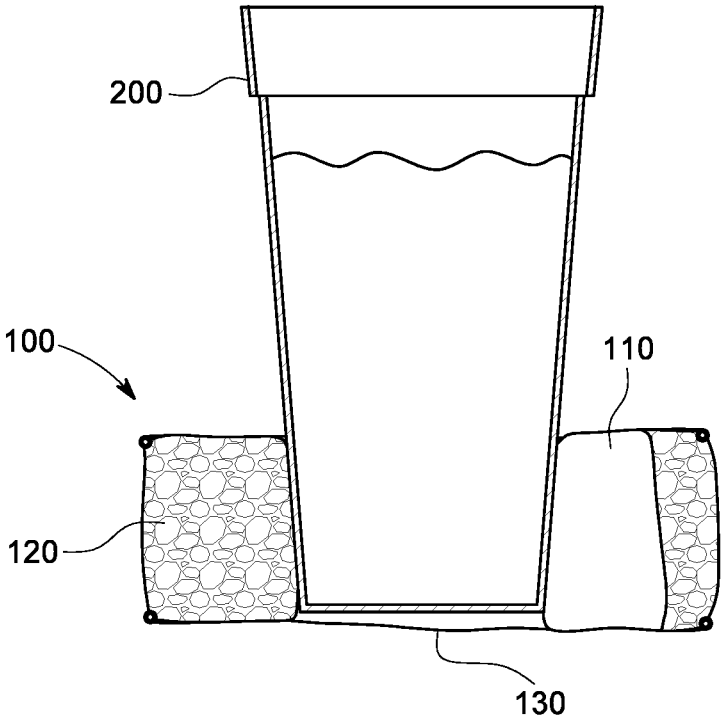
FIG. 6 is a cross section of the glass and first embodiment drink holder of FIG. 2.
Figure 7:
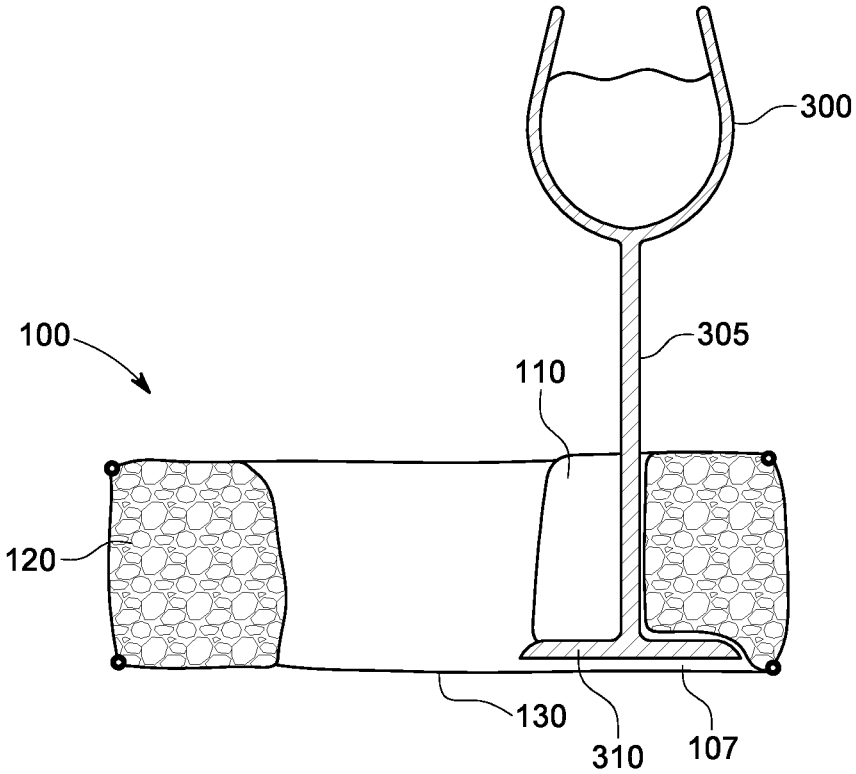
FIG. 7 is a cross section of the wine glass and first embodiment drink holder of FIG. 3.
Figure 8:
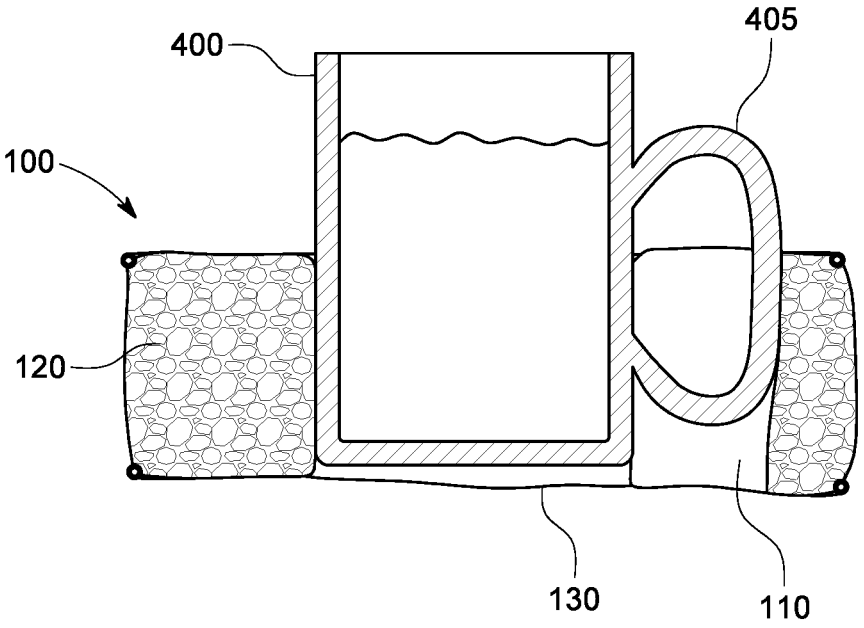
FIG. 8 is a cross section of the wine glass and second embodiment drink holder of FIG. 4.

An Embodiment of the Drink Holder in Combination with Various Beverage Receptacles FIGS. 2-4 & 6-8 illustrate an embodiment of a drink holder 100 in combination with various types of beverage receptacles. FIGS. 2 and 6 show a typical glass or plastic cup 200 as might be used in combination with water, milk, soda or beer cradled in the drink holder. FIGS. 3 and 7 show a piece of stemware 300 secured in the drink holder, and FIGS. 4 & 8 illustrate a coffee cup 400 fitted into the drink holder. Of important note, in the cross sections of FIGS. 6-8, the bottom of each of the beverage receptacles is shown in the illustration as being positioned above the bottom section 130. This is represented this way for clarity only and to differentiate between the bottom section and the bottom of the respective receptacle. In real world use, the bottom of the receptacles will typically rest against the inside surface of bottom section.

As shown in FIGS. 2 and 6 when a typical glass or plastic cup is inserted into the holder, the flexible sides of the holder cradle the bottom of the cup with the fill material 120 flowing and repositioning within the interior space. As mentioned above the diameter of the center hole 105 is about three inches; however, cups that have moderately larger diameters can also be received in the opening as the notch 110 will expand and increase the effective diameter of the opening.

A wine glass or stemware 300 is inserted and cradled in the drink holder 100 in a different manner than a glass or cup as is shown in FIGS. 3 & 7. The base 310 of the stemware is lowered into the center opening until bottoming out against the bottom section. The base is then slid into the annular slot 107 while the associated stem 305 is slid into the notch 110. The weight of the beads overlying the base as well as the sides of the notch cradling the stem act to secure the stemware in the holder effectively stabilizing it.

A coffee cup 400 is received in the drink holder 100 in a manner generally similar to a glass or cup but, as is shown in FIGS. 4 & 8, the cup's handle 405 is received in the notch 110. The center opening 105 cradles the coffee cup much in the same manner as it does a typical cup or glass with the added accommodation for the handle.

Figure 9:
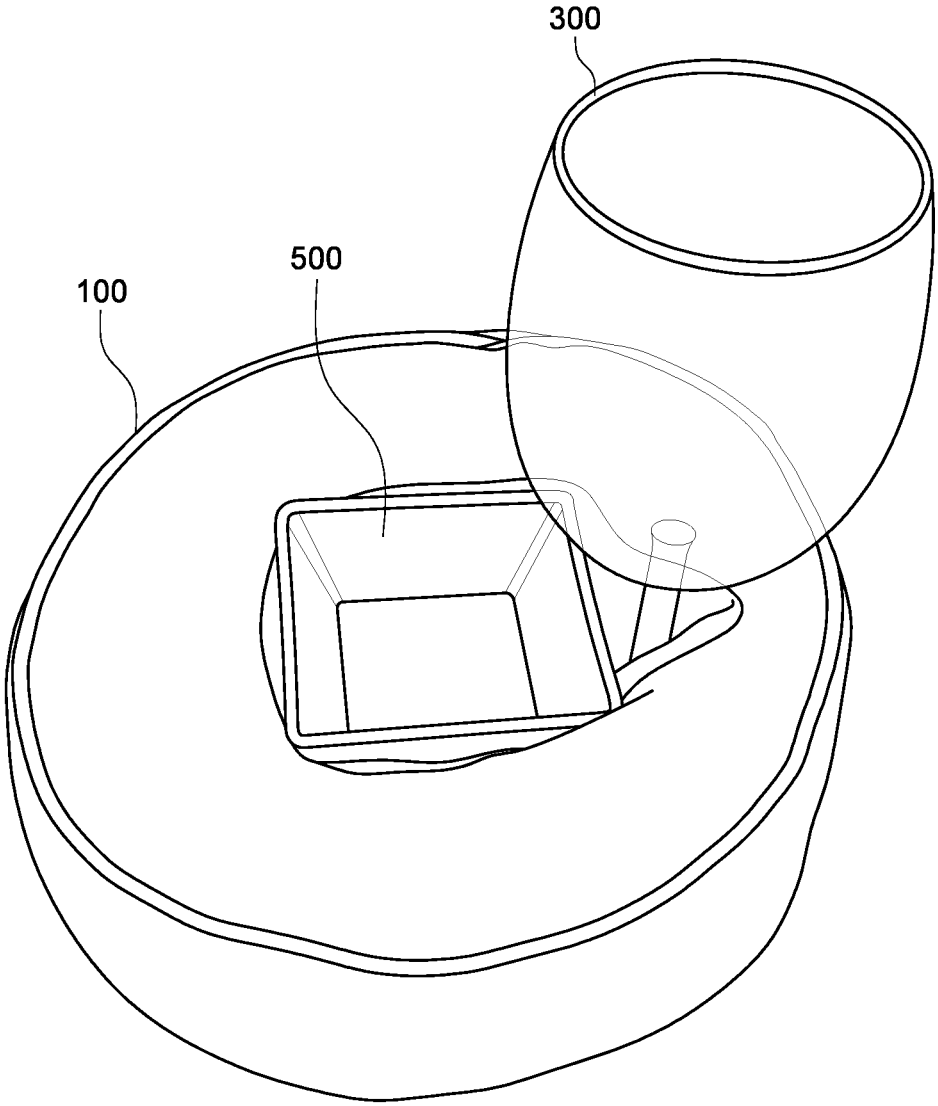
FIG. 9 is an isometric top view of a drink holder with a wine glass and snack dish received therein according to an embodiment of the present invention.

With reference to FIG. 9, the drink holder 100 can be also used to simultaneously hold a stemware glass 300 and a dish 500 as might be used to contain nuts or anther snack. The wine glasses stem is secured in the notch 110 and the snack dish in secured in the center opening 105.

Other Variations and Alternative Embodiments

The various embodiments and variations thereof, illustrated in the accompanying Figures and/or described above, are merely exemplary and are not meant to limit the scope of the invention. It is to be appreciated that numerous other variations of the invention have been contemplated, as would be obvious to one of ordinary skill in the art, given the benefit of this disclosure. All variations of the invention that read upon appended claims are intended and contemplated to be within the scope of the invention.

We claim:

1. A drink holder comprising:

a donut section, the donut section comprising (i) an exterior including a donut top side, a donut bottom side having a donut bottom side perimeter, an exterior sidewall and defining a generally cylindrical center hole extend from an bottom opening through the donut bottom side to a top opening through the donut top side, the exterior comprising flexible donut sheet material, and (ii) an interior substantially filled with fill; and a bottom section, the bottom section comprising flexible bottom sheet material and having a bottom side perimeter;

wherein the bottom side perimeter is attached to the donut section proximate the donut bottom side perimeter to form an annular slot, the annular slot extending from the bottom opening to proximate the bottom side perimeter.

2. The drink holder of claim 1, wherein the donut section further includes a notch opening extending outwardly from the generally cylindrical center hole from the donut top side to the donut bottom side.

3. The drink holder of claim 1, wherein the donut flexible sheet material comprises a faux leather.

4. The drink holder of claim 3, wherein the faux leather comprises a polyurethane leather.

5. The drink holder of claim 1, wherein the donut flexible sheet material comprises a fabric.

6. The drink holder of claim 5, wherein the fabric comprises a stretchable fabric.

7. The drink holder of claim 1, wherein the fill comprises fill beads.

8. The drink holder of claim 7, wherein the fill beads comprise one or more of plastic beads, foam beads, sand, and rice.

9. The drink holder of claim 8, wherein the average largest dimension of the fill beads is about 0.25" or less.

10. The drink holder of claim 1, wherein the drink holder weighs about 1.5 pounds.

11. The drink holder of claim 1, wherein the drink holder is about eight inches in diameter.

12. The drink holder of claim 11, wherein the center hold is about three inches in diameter.

13. The drink holder of claim 1, wherein the bottom sheet material comprises a faux leather.

14. The drink holder of claim 13, wherein the faux leather comprises a polyurethane leather.

15. The drink holder of claim 2 in combination with a coffee cup, the coffee cup having a body and a side handle extending from a side of the body, wherein the body is received in the center hole with the handle substantially received in the notch.

16. The drink holder of claim 2 in combination with a stemware drinking receptacle, the stemware drinking receptacle having a base, a stem extending upwardly from the base, and a bowl extending upwardly from a top end of the stem, wherein the majority of the base is received in the annular slot and the stem is received in the notch.

17. The combination of claim 16, further comprising a snack dish, the snack dish being cradled in the center hole.

18. A drink holder comprising:

a donut section having a donut diameter of about eight inches, the donut section comprising (i) an exterior including a donut top side, a donut bottom side having a donut bottom side perimeter, an exterior sidewall and defining (a) a generally cylindrical center hole with a center hole diameter of about three inches extending from an bottom opening through the donut bottom side to a top opening through the donut top side and (b) a notch opening extending outwardly from the generally cylindrical center hole from the donut top side to the donut bottom side, the exterior comprising flexible donut sheet material, and (ii) an interior substantially filled with fill beads; and a bottom section, the bottom section comprising flexible bottom sheet material and having a bottom side perimeter;

wherein (1) the bottom side perimeter is attached to the donut section proximate the donut bottom side perimeter to form an annular slot, the annular slot extending from the bottom opening to proximate the bottom side perimeter, and (2) the drink holder weighs about one and a half pounds.

19. The drink holder of claim 18, wherein the donut sheet material is water resistant.

20. The drink holder of claim 19, wherein the fill beads comprise a mixture of plastic beads and foam beads.

* * * * *